US005928085A

United States Patent [19]

Lehr

[11] Patent Number: 5,928,085

[45] Date of Patent: Jul. 27, 1999

[54] NOVELTY GAS DISPENSING NOZZLE ATTACHMENT

[76] Inventor: Torii L. Lehr, P.O. Box 60454, Boulder City, Nev. 89006-0454

[21] Appl. No.: 09/150,608

[22] Filed: Sep. 10, 1998

[51] Int. Cl.[6] ..... A63H 37/00

[52] U.S. Cl. ..... 472/51; 446/483

[58] Field of Search ..... 472/51, 54, 55, 472/137; 141/206, 207, 208, 209; 446/483

[56] References Cited

U.S. PATENT DOCUMENTS 2,797,526 7/1957 Milhas, Jr. ..... 446/483

5,655,576 8/1997 Leininger et al. ..... 141/206 X

*Primary Examiner*—Kien T. Nguyen

[57] ABSTRACT

A novelty gas dispensing nozzle attachment for attachment to a fuel cap of a vehicle for simulating a torn away gas dispensing nozzle because the driver forgot to remove the gas dispensing nozzle from the vehicle before driving away from the gas pump. The inventive device includes a main member having an outer configuration adapted to resemble a fuel dispensing nozzle of a gas pump including a middle portion configured to resemble a trigger assembly of a fuel dispensing nozzle, a proximal portion configured to resemble a portion of corrugated protective nozzle bellow inserted into a fuel tank of a vehicle, and a distal portion configured to resemble a torn off portion of a fuel line hose connecting a fuel dispensing nozzle to a gas pump. The proximal portion terminates at an open proximal end which is adapted for receiving a fuel cap of a vehicle therein to attach the main member to the fuel cap.

14 Claims, 2 Drawing Sheets

NOVELTY GAS DISPENSING NOZZLE ATTACHMENT

BACKGROUND OF THE INVENTION

1. Field of the Invention

The present invention relates to novelty attachment for attaching to a vehicle and more particularly pertains to a new novelty gas dispensing nozzle attachment for attachment to a fuel cap of a vehicle for simulating a torn away gas dispensing nozzle because the driver forgot to remove the gas dispensing nozzle from the vehicle before driving away from the gas pump.

2. Description of the Prior Art

The use of novelty attachment for attaching to a vehicle is known in the prior art. More specifically, novelty attachment for attaching to a vehicle heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,928,954; U.S. Pat. No. 5,377,380; U.S. Pat. No. Des. 278,921; U.S. Pat. No. 4,422,633; U.S. Pat. No. 3,818,629; and U.S. Pat. No. 4,450,879.

While these devices fulfill their respective, particular objectives and requirements, the aforementioned patents do not disclose a new novelty gas dispensing nozzle attachment. The inventive device includes a main member having an outer configuration adapted to resemble a fuel dispensing nozzle of a gas pump including a middle portion configured to resemble a trigger assembly of a fuel dispensing nozzle, a proximal portion configured to resemble a portion of corrugated protective nozzle bellow inserted into a fuel tank of a vehicle, and a distal portion configured to resemble a torn off portion of a fuel line hose connecting a fuel dispensing nozzle to a gas pump. The proximal portion terminates at an open proximal end which is adapted for receiving a fuel cap of a vehicle therein to attach the main member to the fuel cap.

In these respects, the novelty gas dispensing nozzle attachment according to the present invention substantially departs from the conventional concepts and designs of the prior art, and in so doing provides an apparatus primarily developed for the purpose of attachment to a fuel cap of a vehicle for simulating a torn away gas dispensing nozzle because the driver forgot to remove the gas dispensing nozzle from the vehicle before driving away from the gas pump.

SUMMARY OF THE INVENTION

In view of the foregoing disadvantages inherent in the known types of novelty attachment for attaching to a vehicle now present in the prior art, the present invention provides a new novelty gas dispensing nozzle attachment construction wherein the same can be utilized for attachment to a fuel cap of a vehicle for simulating a torn away gas dispensing nozzle because the driver forgot to remove the gas dispensing nozzle from the vehicle before driving away from the gas pump.

The general purpose of the present invention, which will be described subsequently in greater detail, is to provide a new novelty gas dispensing nozzle attachment apparatus and method which has many of the advantages of the novelty attachment for attaching to a vehicle mentioned heretofore and many novel features that result in a new novelty gas dispensing nozzle attachment which is not anticipated, rendered obvious, suggested, or even implied by any of the prior art novelty attachment for attaching to a vehicle, either alone or in any combination thereof.

To attain this, the present invention generally comprises a main member having an outer configuration adapted to resemble a fuel dispensing nozzle of a gas pump including a middle portion configured to resemble a trigger assembly of a fuel dispensing nozzle, a proximal portion configured to resemble a portion of corrugated protective nozzle bellow inserted into a fuel tank of a vehicle, and a distal portion configured to resemble a torn off portion of a fuel line hose connecting a fuel dispensing nozzle to a gas pump. The proximal portion terminates at an open proximal end which is adapted for receiving a fuel cap of a vehicle therein to attach the main member to the fuel cap.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new novelty gas dispensing nozzle attachment apparatus and method which has many of the advantages of the novelty attachment for attaching to a vehicle mentioned heretofore and many novel features that result in a new novelty gas dispensing nozzle attachment which is not anticipated, rendered obvious, suggested, or even implied by any of the prior art novelty attachment for attaching to a vehicle, either alone or in any combination thereof.

It is another object of the present invention to provide a new novelty gas dispensing nozzle attachment which may be easily and efficiently manufactured and marketed.

It is a further object of the present invention to provide a new novelty gas dispensing nozzle attachment which is of a durable and reliable construction.

An even further object of the present invention is to provide a new novelty gas dispensing nozzle attachment which is susceptible of a low cost of manufacture with regard to both materials and labor, and which accordingly is then susceptible of low prices of sale to the consuming public, thereby making such novelty gas dispensing nozzle attachment economically available to the buying public.

Still yet another object of the present invention is to provide a new novelty gas dispensing nozzle attachment which provides in the apparatuses and methods of the prior art some of the advantages thereof, while simultaneously overcoming some of the disadvantages normally associated therewith.

Still another object of the present invention is to provide a new novelty gas dispensing nozzle attachment for attachment to a fuel cap of a vehicle for simulating a torn away gas dispensing nozzle because the driver forgot to remove the gas dispensing nozzle from the vehicle before driving away from the gas pump.

Yet another object of the present invention is to provide a new novelty gas dispensing nozzle attachment which includes a main member having an outer configuration adapted to resemble a fuel dispensing nozzle of a gas pump including a middle portion configured to resemble a trigger assembly of a fuel dispensing nozzle, a proximal portion configured to resemble a portion of corrugated protective nozzle bellow inserted into a fuel tank of a vehicle, and a distal portion configured to resemble a torn off portion of a fuel line hose connecting a fuel dispensing nozzle to a gas pump. The proximal portion terminates at an open proximal end which is adapted for receiving a fuel cap of a vehicle therein to attach the main member to the fuel cap.

Still yet another object of the present invention is to provide a new novelty gas dispensing nozzle attachment that provides enjoyment to practical jokers everywhere.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
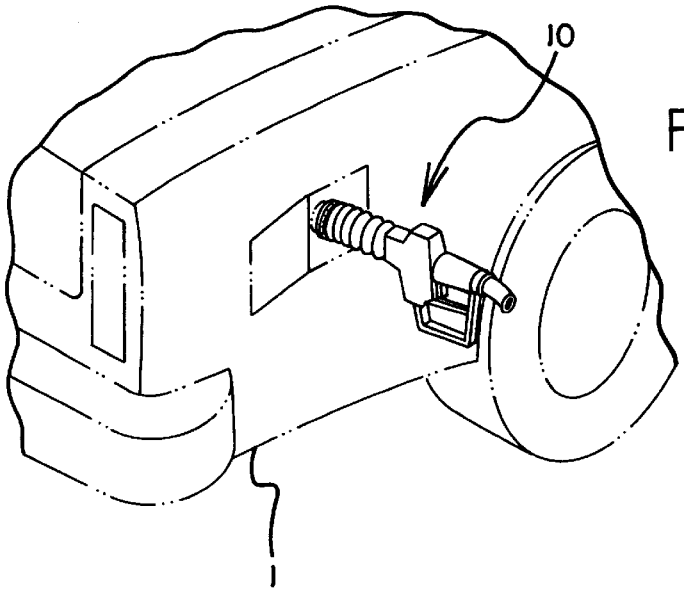
FIG. 1 is a schematic perspective view of a new novelty gas dispensing nozzle attachment in use attached to the fuel cap of a vehicle according to the present invention.
Figure 2:
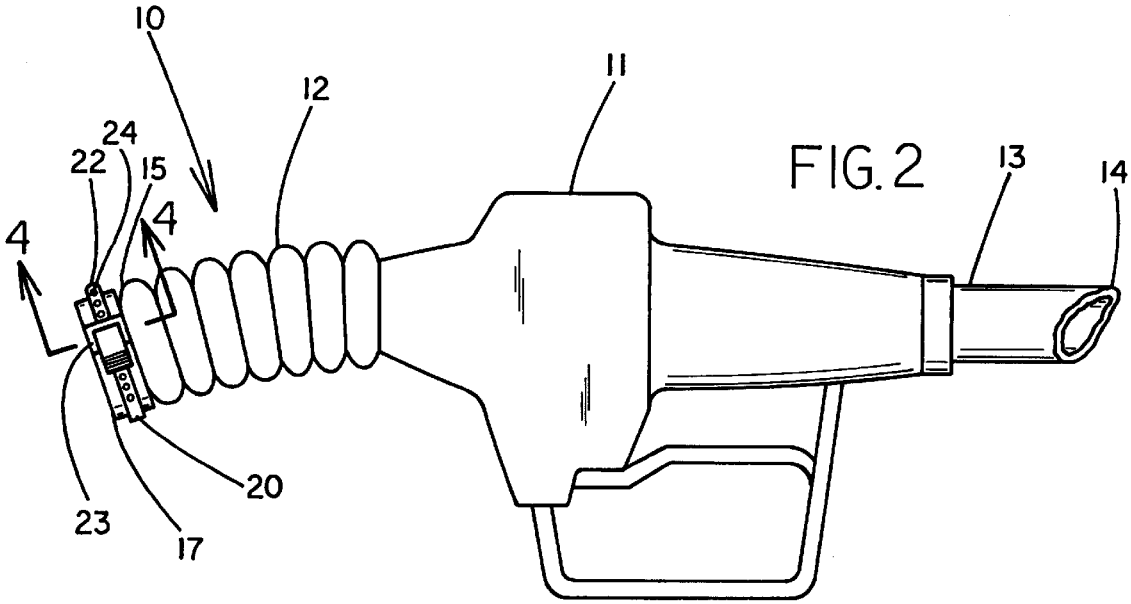
FIG. 2 is a schematic side view of the present invention.
Figure 3:
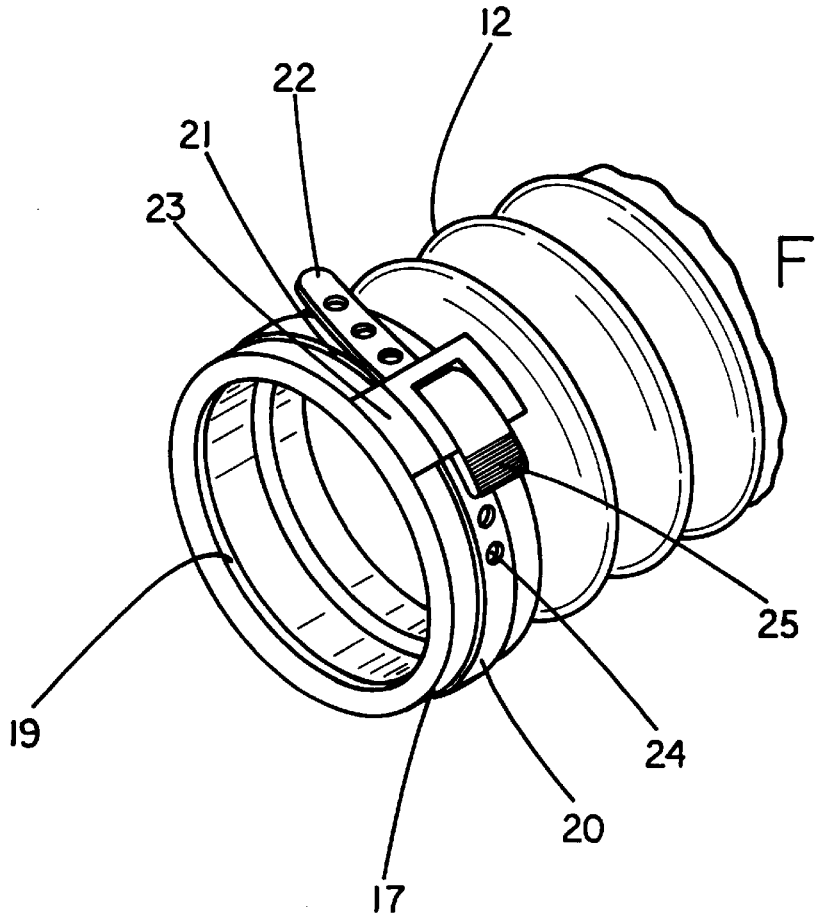
FIG. 3 is a schematic partial perspective view of the proximal end region of the present invention.
Figure 4:
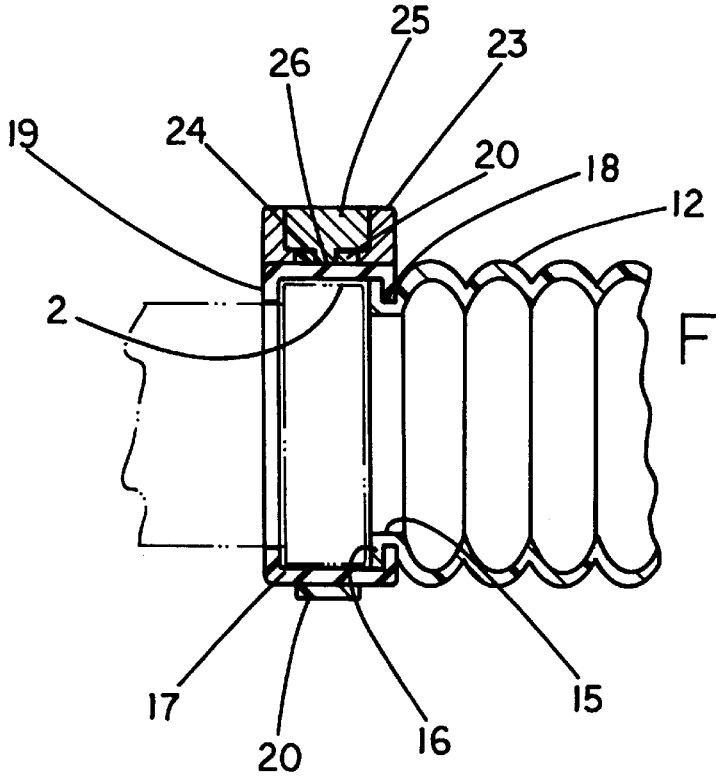
FIG. 4 is a schematic cross sectional view of the present invention taken from line 4—4 of FIG. 2.

With reference now to the drawings, and in particular to FIGS. 1 through 4 thereof, a new novelty gas dispensing nozzle attachment embodying the principles and concepts of the present invention and generally designated by the reference numeral 10 will be described.

As best illustrated in FIGS. 1 through 4, the novelty gas dispensing nozzle attachment 10 generally comprises a main member 10 having an outer configuration adapted to resemble a fuel dispensing nozzle of a gas pump including a middle portion 11 configured to resemble a trigger assembly of a fuel dispensing nozzle, a proximal portion 12 configured to resemble a portion of corrugated protective nozzle bellow inserted into a fuel tank of a vehicle 1, and a distal portion 13 configured to resemble a torn off portion of a fuel line hose connecting a fuel dispensing nozzle to a gas pump. The proximal portion 12 terminates at an open proximal end 15 which is adapted for receiving a fuel cap 2 of a vehicle 1 therein to attach the main member 10 to the fuel cap 2.

In use, the novelty attachment 10 is designed for attaching to a fuel cap 2 of a vehicle 1. Specifically, the main member 10 has an outer configuration adapted to resemble a fuel dispensing nozzle of a gas pump including a middle portion 11 configured to resemble a trigger assembly of a fuel dispensing nozzle, a proximal portion 12 configured to resemble a portion of corrugated protective nozzle bellow inserted into a fuel tank of a vehicle 1, and a distal portion 13 configured to resemble a torn off portion of a fuel line hose connecting a fuel dispensing nozzle to a gas pump. The middle portion 11 preferably comprises a resiliently compressible foamed material such as a foamed rubber, a neoprene or latex material to avoid damage such as dents and scratches from the attachment to the vehicle 1. The distal portion 13 preferably comprises a length of flexible hose and terminates at an open distal end 14. The distal end 14 preferably has a jagged edge therearound to simulate a torn away fuel line hose connecting a fuel dispensing nozzle to a gas pump.

The proximal portion 12 preferably comprises a flexible corrugated tube and terminates at an open proximal end 15. The proximal end 15 has an outwardly radiating annular lip 16 therearound. The annular lip 16 of proximal end 15 defines an annular channel between the proximal end 15 and the proximal portion 12.

A resiliently flexible ring-shaped connector 17 is included with a pair of spaced apart inwardly radiating annular lips 18,19 at the edges of the connector 17. The connector 17 is disposed around the annular lip 16 of the proximal end 15 such that the annular lip 16 of the proximal end 15 is located between the pair of inwardly radiating annular lips 18,19 of the connector 17. A first of the inwardly radiating annular lips 18 of the connector 17 is extended into the annular channel to hold the connector 17 to the main member 10. In use, the connector 17 is adapted for receiving a fuel cap 2 therein. A second of the inwardly radiating annular lips 19 of the connector 17 is adapted for positioning over the threaded lip of the fuel cap 2 by flexing the second inwardly radiating annular lip 19 over the fuel cap 2 to hold the fuel cap 2 in the connector 17.

The connector 17 has an elongate flexible member 20, such as a plastic cable tie, therearound between the inwardly radiating annular lips 18,19 of the connector 17. The elongate flexible member 20 has a pair of opposite ends 21,22. A first of the ends 21 of the elongate flexible member 20 is coupled to the connector 17. In use, the elongate member is adapted for tightening around the fuel cap 2 inserted into the connector 17 to constrict the connector 17 around the fuel cap 2 to hold the main member 10 to the fuel cap 2. The connector 17 has a buckle mechanism 23 coupled thereto adjacent the proximal end 15. A second the ends 22 of the elongate flexible member 20 is extended through the buckle mechanism 23. The buckle mechanism 23 engages the elongate flexible member 20 to hold the elongate flexible member 20 in a position when constricting the connector 17 around the fuel cap 2.

Preferably, the elongate flexible member 20 has a row of holes 24 therethrough extending along the elongate flexible member 20 adjacent the second end 22 of the elongate flexible member 20. The buckle mechanism 23 has a pivotable lever 25 and a pin 26 extending from the lever 25 to engage the elongate flexible member 20. The pin 26 is inserted into one of the holes 24 of the elongate flexible member 20 and the lever 25 is pivoted to a position to pinch the elongate flexible member 20 between the connector 17 and the lever 25 to hold the elongate flexible member 20 therebetween. The pin 26 prevents the elongate flexible member 20 from being removed from the buckle mechanism 23 when the lever 25 is pivoted to the position to pinch the elongate flexible member 20 between the connector 17 and the lever 25.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A novelty attachment for attaching to a fuel cap of a vehicle, said novelty attachment comprising:

a main member having an outer configuration adapted to resemble a fuel dispensing nozzle of a gas pump including a middle portion configured to resemble a trigger assembly of a fuel dispensing nozzle, a proximal portion configured to resemble a portion of corrugated protective nozzle bellow inserted into a fuel tank of a vehicle, and a distal portion configured to resemble a torn off portion of a fuel line hose connecting a fuel dispensing nozzle to a gas pump;

said proximal portion terminating at an open proximal end; and said open proximal end having means for receiving a fuel cap of a vehicle inserted therein.

2. The novel attachment of claim 1, wherein said middle portion comprises a resiliently compressible foamed material, said distal portion comprising a length of flexible hose and terminating at an open distal end, said open distal end having a jagged edge therearound to simulate a torn away fuel line hose connecting a fuel dispensing nozzle to a gas pump, said proximal portion comprising a flexible corrugated tube.

3. The novelty attachment of claim 1, wherein said open proximal end has an outwardly radiating annular lip therearound, said annular lip of open proximal end defining an annular channel between said open proximal end and said proximal portion.

4. The novelty attachment of claim 3, said means for receiving a fuel cap comprising a resiliently flexible ring-shaped connector having a pair of spaced apart inwardly radiating annular lips, said connector being disposed around said annular lip of said open proximal end such that said annular lip of said open proximal end is located between said pair of inwardly radiating annular lips of said connector, a first of said inwardly radiating annular lips of said connector being extended into said annular channel to hold said connector to said main member, and said connector being adapted for receiving a fuel cap therein.

5. The novelty attachment of claim 4, wherein said connector has an elongate flexible member therearound, said elongate flexible member having a pair of opposite ends, a first of said ends of said elongate flexible member being coupled to said connector, said elongate member being adapted for tightening around the fuel cap inserted into said connector to constrict said connector around the fuel cap to hold said main member to the fuel cap.

6. The novelty attachment of claim 5, wherein said connector has a buckle mechanism adjacent said open proximal end, a second said ends of said elongate flexible member being extended through said buckle mechanism, said buckle mechanism engaging said elongate flexible member to hold said elongate flexible member in a position when constricting said connector around the fuel cap.

7. The novelty attachment of claim 6, wherein said elongate flexible member has a row of holes therethrough extending along said elongate flexible member adjacent said second end of said elongate flexible member, wherein said buckle mechanism has a pivotable lever and a pin extending from said lever to engage said elongate flexible member, and wherein said pin is inserted into one of said holes of said elongate flexible member, said lever being pivoted to a position to pinch said elongate flexible member between said connector and said lever to hold said elongate flexible member therebetween, said pin preventing said elongate flexible member from being removed from said buckle mechanism when said lever is pivoted to said position to pinch said elongate flexible member between said connector and said lever.

8. A novelty attachment for attaching to a fuel cap of a vehicle, said novelty attachment comprising:

a main member having an outer configuration adapted to resemble a fuel dispensing nozzle of a gas pump including a middle portion configured to resemble a trigger assembly of a fuel dispensing nozzle, a proximal portion configured to resemble a portion of corrugated protective nozzle bellow inserted into a fuel tank of a vehicle, and a distal portion configured to resemble a torn off portion of a fuel line hose connecting a fuel dispensing nozzle to a gas pump;

said middle portion comprising a resiliently compressible foamed material;

said distal portion comprising a length of flexible hose and terminating at an open distal end, said distal end having a jagged edge therearound to simulate a torn away fuel line hose connecting a fuel dispensing nozzle to a gas pump;

said proximal portion comprising a flexible corrugated tube and terminating at an open proximal end;

said proximal end having an outwardly radiating annular lip therearound, said annular lip of proximal end defining an annular channel between said proximal end and said proximal portion;

a resiliently flexible ring-shaped connector having a pair of spaced apart inwardly radiating annular lips, said connector being disposed around said annular lip of said proximal end such that said annular lip of said proximal end is located between said pair of inwardly radiating annular lips of said connector, a first of said inwardly radiating annular lips of said connector being extended into said annular channel to hold said connector to said main member;

said connector being adapted for receiving a fuel cap therein;

said connector having an elongate flexible member therearound, said elongate flexible member having a pair of opposite ends, a first of said ends of said elongate flexible member being coupled to said connector;

said elongate member being adapted for tightening around the fuel cap inserted into said connector to constrict said connector around the fuel cap to hold said main member to the fuel cap;

said connector having a buckle mechanism adjacent said proximal end, a second said ends of said elongate flexible member being extended through said buckle mechanism;

said buckle mechanism engaging said elongate flexible member to hold said elongate flexible member in a position when constricting said connector around the fuel cap;

said elongate flexible member having a row of holes therethrough extending along said elongate flexible member adjacent said second end of said elongate flexible member; and said buckle mechanism having a pivotable lever and a pin extending from said lever to engage said elongate flexible member, said pin being inserted into one of said holes of said elongate flexible member, said lever being pivoted to a position to pinch said elongate flexible member between said connector and said lever to hold said elongate flexible member therebetween, said pin preventing said elongate flexible member from being removed from said buckle mechanism when said lever is pivoted to said position to pinch said elongate flexible member between said connector and said lever.

9. A novelty attachment for attaching to a fuel cap of a vehicle, said novelty attachment comprising:

a main member having an outer configuration adapted to resemble a fuel dispensing nozzle of a gas pump including a middle portion configured to resemble a trigger assembly of a fuel dispensing nozzle, a proximal portion configured to resemble a portion of corrugated protective nozzle bellow inserted into a fuel tank of a vehicle, and a distal portion configured to resemble a torn off portion of a fuel line hose connecting a fuel dispensing nozzle to a gas pump;

said proximal portion terminating at an open proximal end; and a resiliently flexible ring-shaped connector being disposed around said open proximal end, said connector being adapted for receiving a fuel cap inserted therein.

10. The novelty attachment of claim 9, wherein said connector has an elongate flexible member therearound, said elongate member being adapted for tightening around the fuel cap inserted into said connector to constrict said connector around the fuel cap to hold said main member to the fuel cap.

11. The novelty attachment of claim 10, wherein said connector has a buckle mechanism for releasably holding said flexible member in a position where is connector constricted by said flexible member.

12. The novel attachment of claim 9, wherein said middle portion comprises a resiliently compressible foamed material, said distal portion comprising a length of flexible hose and terminating at an open distal end, said open distal end having a jagged edge therearound to simulate a torn away fuel line hose connecting a fuel dispensing nozzle to a gas pump, said proximal portion comprising a flexible corrugated tube.

13. The novelty attachment of claim 9, wherein said open proximal end has an outwardly radiating annular lip therearound, said annular lip of open proximal end defining an annular channel between said open proximal end and said proximal portion.

14. The novelty attachment of claim 13, wherein said connector has a pair of spaced apart inwardly radiating annular lips, said connector being disposed around said annular lip of said open proximal end such that said annular lip of said open proximal end is located between said pair of inwardly radiating annular lips of said connector, a first of said inwardly radiating annular lips of said connector being extended into said annular channel to hold said connector to said main member.

* * * * *